US008936485B2

(12) United States Patent
Gessford et al.

(10) Patent No.: US 8,936,485 B2
(45) Date of Patent: Jan. 20, 2015

(54) GROUND SPRING WITH STRAIN RELIEF

(75) Inventors: Marc A. Gessford, North Plains, OR (US); Lawrence M. LeMon, Beaverton, OR (US); Jerry R. Shane, Portland, OR (US)

(73) Assignee: Tektronix, Inc., Beaverton, OR (US)

( * ) Notice: Subject to any disclaimer, the term of this patent is extended or adjusted under 35 U.S.C. 154(b) by 112 days.

(21) Appl. No.: 13/594,044

(22) Filed: Aug. 24, 2012

(65) Prior Publication Data

US 2013/0171868 A1 Jul. 4, 2013

Related U.S. Application Data

(60) Provisional application No. 61/582,967, filed on Jan. 4, 2012.

(51) Int. Cl.
*H01R 9/05* (2006.01)

(52) U.S. Cl.
USPC ..... 439/578

(58) Field of Classification Search
USPC ..... 43/578, 580–585, 579
See application file for complete search history.

(56) References Cited

U.S. PATENT DOCUMENTS

| | | | | |
|---|---|---|---|---|
| 3,678,445 | A | 7/1972 | Brancaleone | |
| 5,830,010 | A * | 11/1998 | Miskin et al. | 439/578 |
| 5,871,371 | A * | 2/1999 | Rothenberger et al. | 439/579 |
| 2012/0171894 | A1 * | 7/2012 | Malloy et al. | 439/578 |
| 2012/0214339 | A1 * | 8/2012 | Stein | 439/578 |

* cited by examiner

*Primary Examiner* — Jean F Duverne
(74) *Attorney, Agent, or Firm* — William K. Bucher; Marger Johnson & McCollom PC

(57) ABSTRACT

A ground spring for receiving a ground end of a high-frequency test probe is described. The ground spring includes a generally annular base portion, and a number of elongated spring fingers extending from the base portion. The fingers extend generally radially inwardly from the base portion and have inner end faces that together define a substantially circular opening in a center portion of the ground spring. Each of the fingers have a tapered shape including a wider base portion end and a narrower inner end portion Each of the fingers has a longitudinal axis that is aslant relative to a reference line extending from the center of the ground spring to a center of the base portion of each finger. BMA connectors including the ground spring and test and measurement devices are also described.

19 Claims, 5 Drawing Sheets

GROUND SPRING WITH STRAIN RELIEF

RELATED APPLICATIONS

This application claims the benefit of U.S. provisional application No. 61/582,967, filed Jan. 4, 2012, the contents of which are incorporated by reference herein.

FIELD OF THE INVENTION

This disclosure relates to test and measurement equipment, and, more particularly, to a high precision ground spring for test and measurement equipment that allows the instrument to accurately measure high frequency signals.

BACKGROUND

Test and measurement equipment receives signals through test leads and performs measurements on them. Leads are coupled to the equipment through connectors. One form of connector is called a BMA lead, which stands for "BlindMate A" connectors, which are RF (Radio Frequency) connectors that receive test signals having high frequencies, such as microwave radio frequencies in the 0.3 GHz to 300 GHz range.

A ground spring is a spring that contacts the ground of a BMA connector. The ground spring function is to provide an electrical connection to the BMA connector, so that signals may be measured relative to this ground. Present ground springs suffer from reliability problems. They oftentimes fail to make adequate connection to the ground connection, which causes data dropouts on the tested signal, especially in signals having frequencies higher than approximately 20 GHz. Present ground springs also tend to lose their spring function after only a few cycles of connector insertion and removal.

Embodiments of the invention address these and other problems in the prior art.

SUMMARY OF THE INVENTION

Accordingly, the present invention is for a ground spring for receiving a ground end of a high-frequency test probe. The ground spring has a generally annular base portion and a plurality of elongated spring fingers extending from the base portion. The elongated spring fingers generally radiate inwardly and have inner end faces that together define a substantially circular opening in a center of the ground spring. Each of the fingers has a tapered shape including a wider base end and a narrower inner end. Each of the fingers has a longitudinal axis that is aslant relative to a reference line extending from a center of the ground spring to a center of the base end of each finger.

Each adjacent finger has a gap formed there between that narrows as the gap extends from the annular base portion toward the center of the ground spring. The ground spring has a generally dished shape having a height of approximately 0.017 inches. Each of the elongated spring fingers extending from the base portion is substantially planar. The ground spring is preferably formed from Beryllium Copper having gold plating thereon with the elongate spring fingers being approximately 0.0025 inches thick. Each of the elongate spring fingers has a longitudinal axis that is aslant from a reference line extending from the center of the ground spring to a center of the base portion by approximately 40 degrees.

The ground spring is disposed in a female portion of a BMA connector having a generally cylindrical receiver portion for receiving a male portion of a matched BMA connector. The ground spring receives a ground end of the male portion of the matched BMA connector. The ground spring has a generally annular base portion and a plurality of elongated spring fingers extending from the base portion. The elongated spring fingers generally radiate inwardly and have inner end faces that together define a substantially circular opening in a center of the ground spring. Each of the fingers has a tapered shape including a wider base end and a narrower inner end. Each of the fingers has a longitudinal axis that is aslant relative to a reference line extending from a center of the ground spring to a center of the base end of each finger The ground spring is implemented in a test and measurement instrument having a processor structured to accept an input signal and generate an output therefrom. The test and measurement instrument has a display unit structured to display the output from the processor and an input unit including a female portion of a BMA connector. The female portion of the BMA connector has a generally cylindrical receiver portion for receiving a male portion of a matched BMA connector and the ground spring for receiving a ground end of the male portion of the matched BMA connector. The ground spring has a generally annular base portion and a plurality of elongated spring fingers extending from the base portion. The elongated spring fingers generally radiate inwardly and have inner end faces that together define a substantially circular opening in a center of the ground spring. Each of the fingers has a tapered shape including a wider base end and a narrower inner end. Each of the fingers has a longitudinal axis that is aslant relative to a reference line extending from a center of the ground spring to a center of the base end of each finger.

The objects, advantages and novel features of the present invention are apparent from the following detailed description when read in conjunction with appended claims and attached drawings.

DETAILED DESCRIPTION

Figure 1:
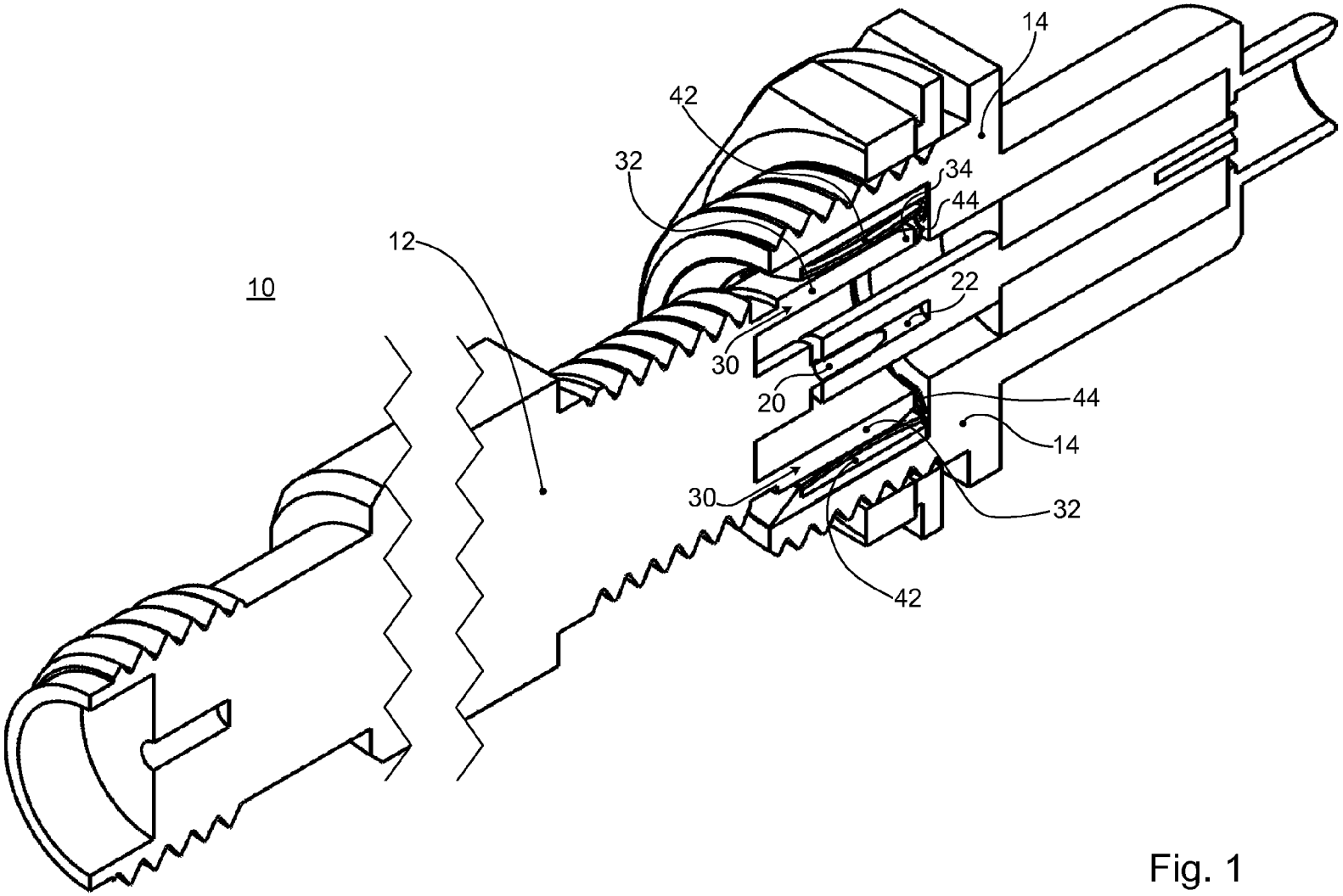
FIG. 1 is an isometric cut-away diagram of a BMA connector including a ground spring according to embodiments of the present invention.
Figure 2:
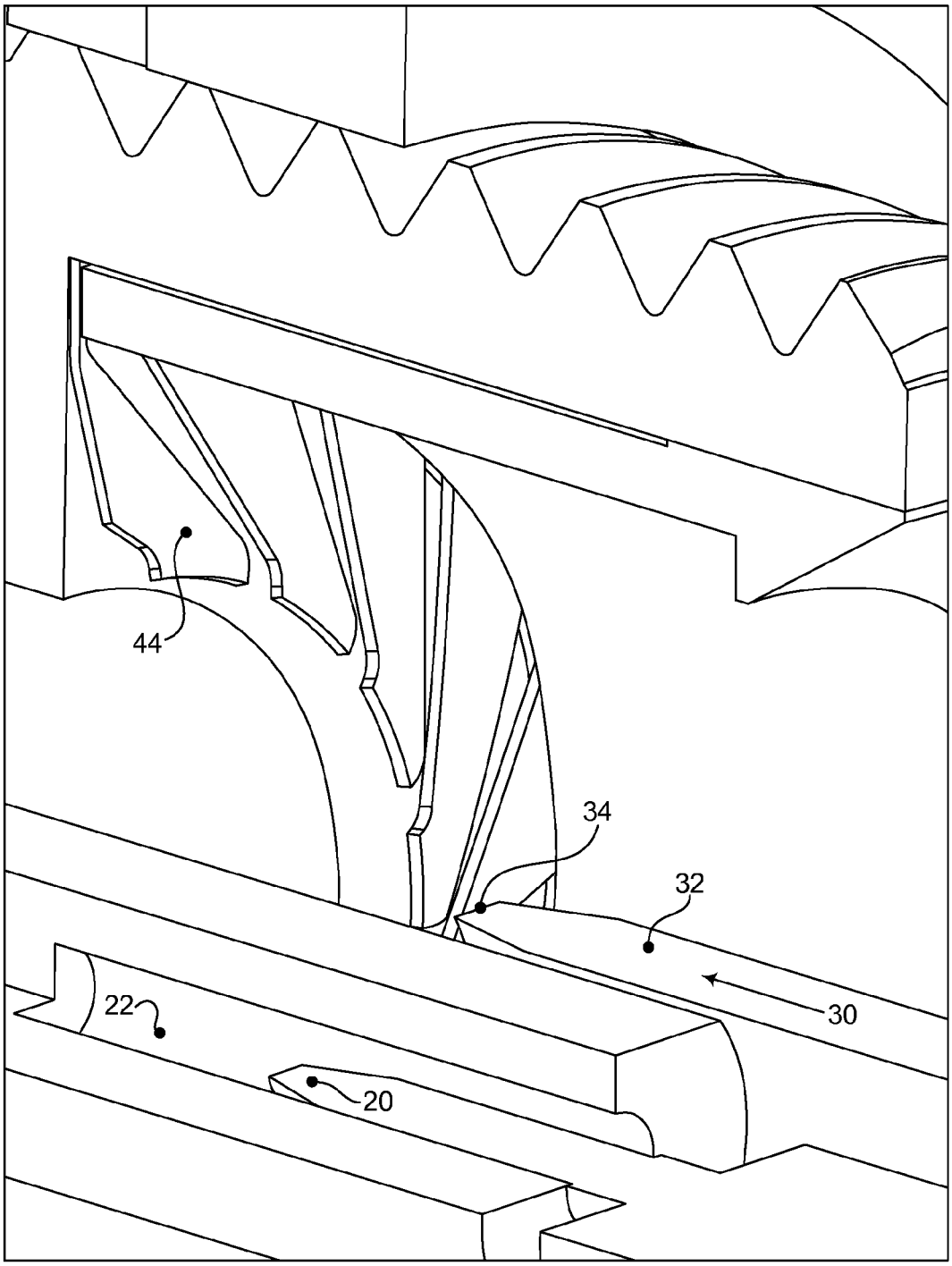
FIG. 2 is an isometric partial cut-away diagram of the BMA connector of FIG. 1, enlarged to see additional detail of the ground spring.

FIGS. 1 and 2 are isometric cut-away diagrams of a BMA connector 10 including a ground spring according to embodiments of the present invention.

The BMA connector 10 includes a male portion 12 and female portion 14, which may be manually separated from one another or connected to one another. Typically the female portion 14 is mounted to test and measurement equipment and the male portion 12 is removably connected to the female portion. The male portion 12 of the BMA connector may also be called a probe.

When connecting the male portion 12 of the BMA connector 10 to the female portion 14, the male portion is inserted, or plugged into, the female portion. A male pin 20 of the male portion 12 is received in a corresponding receiver 22 on the female portion 14. A ground 30 of the male portion 12 includes a side ground 32 and an end ground 34. When inserted, the side ground 32 contacts a barrel spring 42 (FIG. 1), as illustrated. The end ground 34 of the male portion 12 contacts a ground spring 44. As described above, it is important that the ground spring 44 makes a good ground connection to the male portion 12 of the BMA connector 10 so that the ground signal may be correctly interpreted by the test and measurement device to which the BMA connector 10 is coupled.

As better illustrated in FIG. 2, when the male portion 12 of the BMA connector 10 is fully inserted into the female portion, the end ground 34 makes physical contact with the ground spring 44. This causes the fingers of the ground spring 44, described in detail below, to flex. The return spring force of the fingers of the ground spring 44 holds the ground spring in constant contact with the end ground 34 of the male portion 12 of the BMA connector, making for a solid electrical connection to be used by the test and measurement device.

Figure 3:
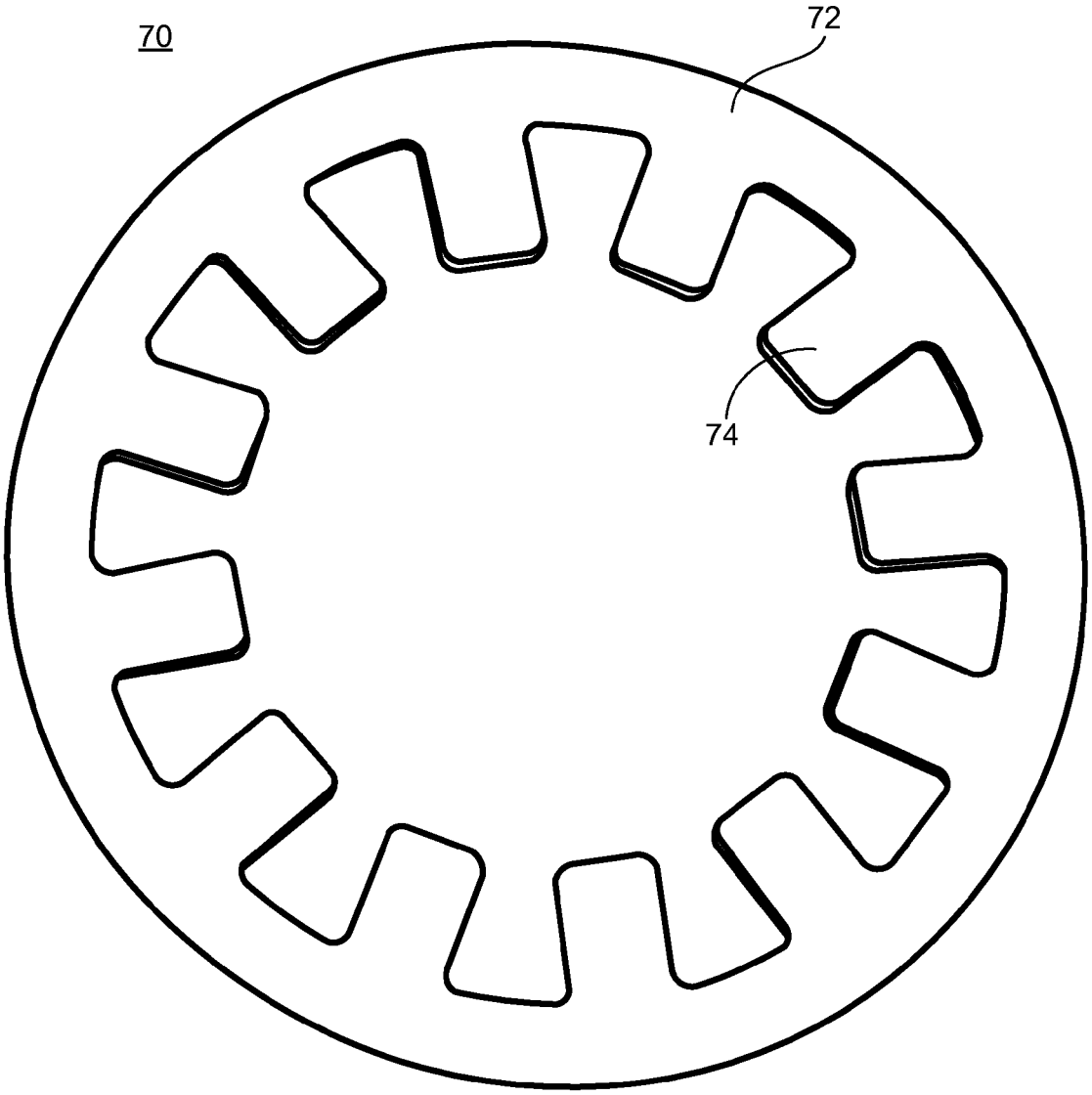
FIG. 3 is top view of a conventional ground spring.

FIG. 3 is top view of a conventional ground spring 70. The ground spring 70 includes an annular portion 72 and a series of extensions 74. Although not illustrated, the extensions 74 are dished from the annular portion 72. When the male portion 12 of the BMA connector 10 is inserted into the female portion 14 and received at the conventional ground spring 70, the extensions 74 tend to yield. In other words, the stress of inserting the male portion of the BMA connector forces the extensions 74 to flex beyond their elastic limit, i.e., beyond the limit from which they will return to their original position upon unloading. When the extensions 74 are flexed beyond this limit, they permanently deform, and fail to make good ground contact with the male portion 12 of the BMA connector 10. This causes signal dropouts in the measured signal. Some of the dropouts may be caused by not all of the extensions 74 being able to contact the male portion 12 of the BMA connector 10 due to the previous yielding.

Figure 4:
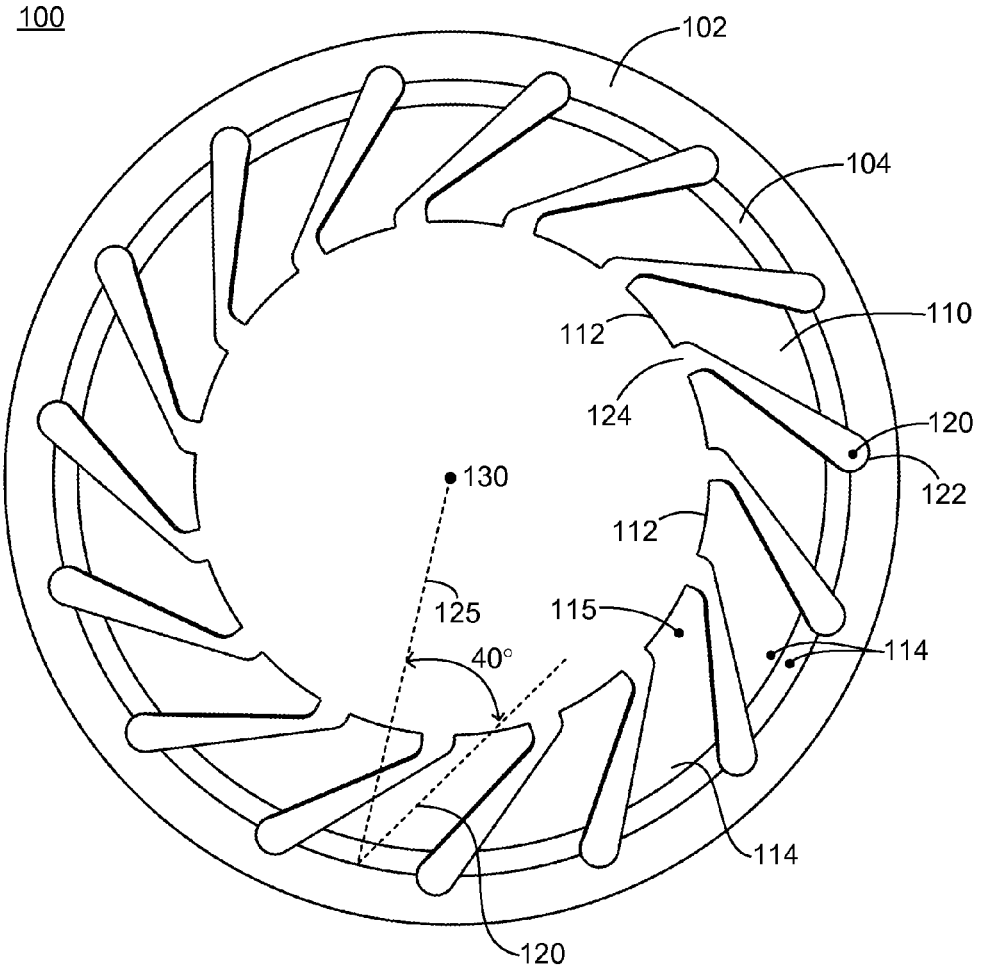
FIG. 4 is a top view of a ground spring according to embodiments of the present invention.

FIG. 4 is a top view of a ground spring 100 according to embodiments of the present invention. The ground spring 100 has the same external shape and dimensions as the conventional spring 70, and fits within a standard BMA connector without modification.

The ground spring 100 includes a generally annular base portion 102, and a number of elongated spring fingers 110 extending from the base portion. The fingers 110 extend generally radially inwardly from the base portion 102 and have inner end faces 112 that together define a substantially circular opening in a center portion of the ground spring 100. Each of the fingers 110 has a tapered shape including a wider base portion 114 end and a narrower inner end portion 115.

Each of the fingers 110 has a longitudinal axis 120 that is aslant relative to a reference line 125 extending from the center 130 of the ground spring 100 to a center of the base portion 114 of each finger. In a preferred embodiment, the angle between the reference line 125 and the longitudinal axis 120 is between 30 and 50 degrees, and preferably approximately 40 degrees. Of course, other offset angles also operate according to the same principles as disclosed herein and selection of a particular angle may be an implementation choice.

Note that compared to the extensions 74 of FIG. 2, the fingers 110 of the ground spring 100 are much longer, which reduces the stress of the fingers 110 when the male portion 12 of the BMA connector 10 is inserted and contacts the spring 100.

The ground spring 100 is preferably made from Beryllium Copper, and may further be coated by a layer of gold using conventional methods. The ground spring is preferably approximately 0.0025 inches thick at both the base portion 114 and the inner end 115. The ground spring 100 may be formed by any appropriate method, and preferably by using Electric Discharge Machining (EDM) techniques. After the general shape of the spring 100 is cut by EDM, it is shaped, such as by dishing, to a shape described below with reference to FIG. 5. After being dished, the ground spring 100 is chemically etched, then heat treated to increase the total strength of the spring. Finally, the ground spring 100 may be plated by gold having a nickel underplate.

A gap 120 between two adjacent fingers 110 includes a rounded end 122 and an open end 124 that opens to the center portion of the ground spring 100. The gap 120 narrows as the gap extends from the annular base portion 102 toward the center 130 of the ground spring.

Figure 5:
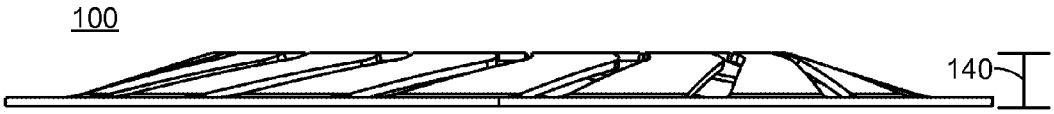
FIG. 5 is a side view of the ground spring of FIG. 3.

As illustrated in FIG. 5, the ground spring 100 may be formed to have a generally dished shape formed by bending the fingers 110 at a transition ring 104 (FIG. 4). In one embodiment the thickness 140 of the dished shape is approximately 0.014 to 0.017 inches. From an inner edge of the transition ring 104, the fingers 110 are preferably generally flat. In other words, the fingers 110 extend along a plane from the inner edge of the transition ring 104 toward the center 130 of the ground spring 100, and the dish shape of the ground spring is caused by deforming the spring in the transition ring 104. Preferably the fingers 110 are also flat across a width of each finger, so that there is no rounded shape across a transverse plane of the fingers 110. This shape helps spread the stress of inserting the male portion 12 of the BMA connector 10 across the entire spring 100, and keeps the fingers 110 within the elastic limit of the spring. This allows the spring 100 to be used hundreds or thousands of times, and returns to the original deflection after the BMA connector has been removed.

Figure 6:
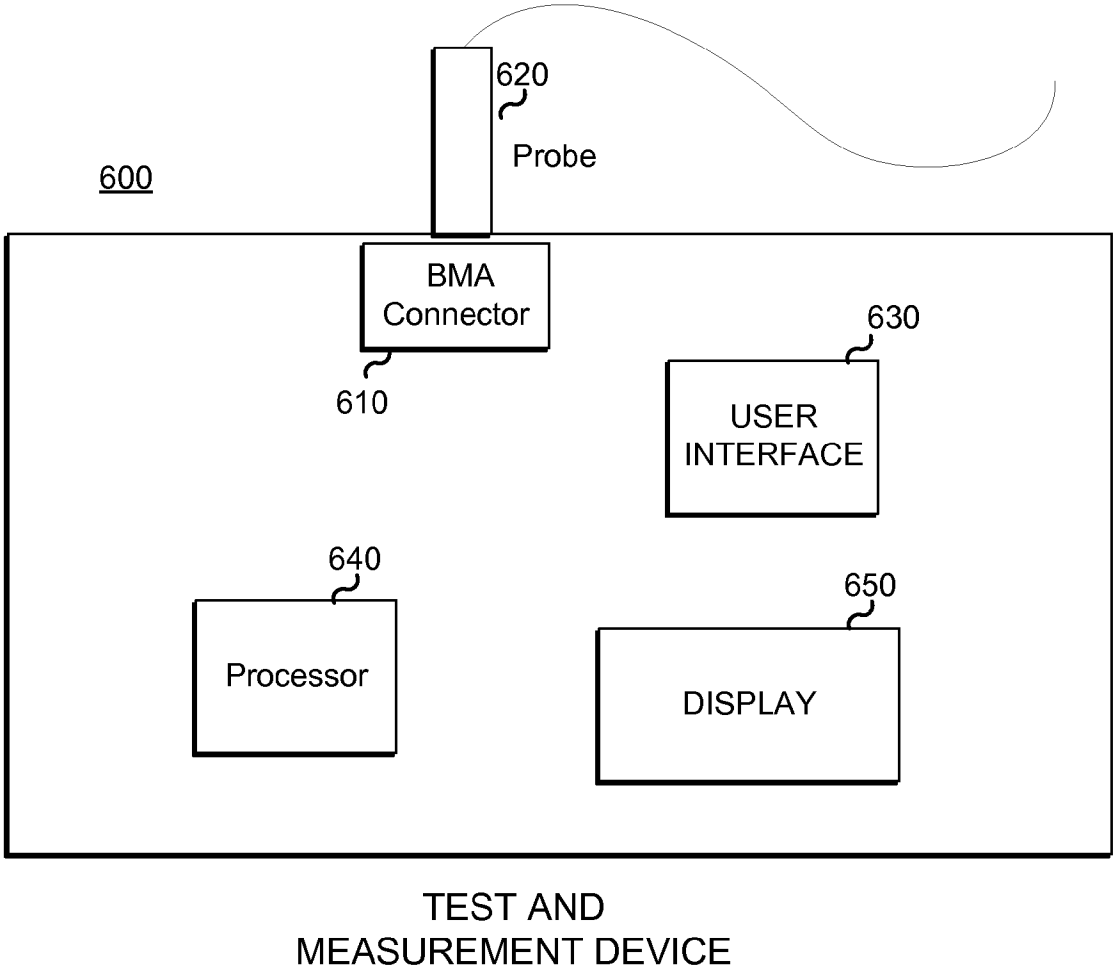
FIG. 6 is a block diagram of a test and measurement device including a ground spring according to embodiments of the invention.

FIG. 6 is a block diagram of a test and measurement device 600 including a ground spring according to embodiments of the invention. The test and measurement device includes a BMA connector 610, into which a probe 620, or the male portion of a BMA connecter may be inserted. The BMA connector 610 includes the ground spring 100 of FIG. 4 to contact a male portion of the BMA connector and make ground contact. A signal to be tested by the measurement device 600 is carried from whatever is being tested along a test lead to the receiving BMA connector 610.

Once the test and measurement device 600 receives a signal under test, a processor 640 performs various operations and processes on the signal, or on other signals (not pictured). The processes may be controlled by a user through a user interface 630 using conventional means. The output of the test and measurement device 600 may then be directed to a display 650, or to other forms of output for use by a user of the device 600.

Having described and illustrated the principles of the invention with reference to illustrated embodiments, it will be recognized that the illustrated embodiments may be modified in arrangement and detail without departing from such principles, and may be combined in any desired manner. And although the foregoing discussion has focused on particular embodiments, other configurations are contemplated. In particular, even though expressions such as "according to an embodiment of the invention" or the like are used herein, these phrases are meant to generally reference embodiment possibilities, and are not intended to limit the invention to particular embodiment configurations. As used herein, these terms may reference the same or different embodiments that are combinable into other embodiments.

Consequently, in view of the wide variety of permutations to the embodiments described herein, this detailed description and accompanying material is intended to be illustrative only, and should not be taken as limiting the scope of the invention. What is claimed as the invention, therefore, is all such modifications as may come within the scope and spirit of the following claims and equivalents thereto.

What is claimed is:

1. A ground spring configured to receive a ground end of a high-frequency test probe, the ground spring comprising:

a generally annular base portion;

a plurality of elongated spring fingers extending from the base portion generally radially inwardly and having inner end faces that together define a substantially circular opening in a center of the ground spring, each of the fingers having a tapered shape including a wider base end and a narrower inner end, and each of the fingers having a longitudinal axis that is aslant relative to a reference line extending from a center of the ground spring to a center of the base end of each finger; and a plurality of gaps, each gap extending between two adjacent fingers from within the base portion through a transition ring to the center of the ground spring.

2. The ground spring of claim 1 in which the gap between two adjacent fingers narrows as the gap extends from the annular base portion toward the center of the ground spring.

3. The ground spring of claim 1 in which the spring has a generally dished shape.

4. The ground spring of claim 2 in which the dished height is approximately 0.017 inches.

5. The ground spring of claim 1 in which the ground spring is formed from Beryllium Copper.

6. The ground spring of claim 1 in which the fingers are approximately 0.0025 inches thick.

7. The ground spring of claim 1 further comprising gold plating.

8. The ground spring of claim 1 in which the fingers are substantially planar.

9. The ground spring of claim 1 in which the longitudinal axis is aslant from the reference line by approximately 40 degrees.

10. A female portion of a BMA connector comprising:

a generally cylindrical receiver portion for receiving a male portion of a matched BMA connector; and a ground spring configured to receive a ground end of the male portion of the matched BMA connector, the ground spring including:

a generally annular base portion, a plurality of elongated spring fingers extending from the base portion generally radially inwardly and having inner end faces that together define a substantially circular opening in a center of the ground spring, each of the fingers having a tapered shape including a wider base end and a narrower inner end, and each of the fingers having a longitudinal axis that is aslant relative to a reference line extending from a center of the ground spring to a center of the base end of each finger, and a plurality of gaps, each gap extending between two adjacent fingers from within the base portion through a transition ring to the center of the ground spring.

11. The BMA connector of claim 10 in which the gap between two adjacent fingers of the ground spring narrows as the gap extends from the annular base portion toward the center of the ground spring, and in which the fingers are substantially planar.

12. The BMA connector of claim 10 in which the ground spring has a generally dished shape of approximately 0.017 inches.

13. The BMA connector of claim 10 in which the ground spring is formed from gold-plated Beryllium Copper.

14. The BMA connector of claim 10 in which the fingers are approximately 0.0025 inches thick.

15. A test and measurement instrument comprising:

a processor structured to accept an input signal and generate an output therefrom;

a display unit structured to display the output from the processor; and an input unit including a female portion of a BMA connector, the female portion of the BMA connector having:

a generally cylindrical receiver portion for receiving a male portion of a matched BMA connector, a ground spring configured to receive a ground end of the male portion of the matched BMA connector, the ground spring including:

a generally annular base portion, a plurality of elongated spring fingers extending from the base portion generally radially inwardly and having inner end faces that together define a substantially circular opening in a center of the ground spring, each of the fingers having a tapered shape including a wider base end and a narrower inner end, and each of the fingers having a longitudinal axis that is aslant relative to a reference line extending from a center of the ground spring to a center of the base end of each finger, and a plurality of gaps, each gap extending between two adjacent fingers from within the base portion through a transition ring to the center of the ground spring.

16. The test and measurement instrument of claim 15 in which the gap between two adjacent fingers of the ground spring narrows as the gap extends from the annular base portion toward the center of the ground spring, and in which the fingers are substantially planar.

17. The test and measurement instrument of claim 15 in which the ground spring has a generally dished shape of approximately 0.017 inches.

18. The test and measurement instrument of claim 15 in which the ground spring is formed from gold-plated Beryllium Copper.

19. The test and measurement instrument of claim 15 in which the fingers are approximately 0.0025 inches thick.

* * * * *